US009292991B2

(12) United States Patent
Lavoie

(10) Patent No.: US 9,292,991 B2
(45) Date of Patent: Mar. 22, 2016

(54) RECEPTACLE ASSEMBLY AND A REVERSE VENDING MACHINE COMPRISING SAID RECEPTACLE ASSEMBLY

(71) Applicant: TOMRA North America, Inc., Shelton, CT (US)

(72) Inventor: Peter Lavoie, Shelton, CT (US)

(73) Assignee: TOMRA NORTH AMERICA, INC., Shelton, CT (US)

( * ) Notice: Subject to any disclaimer, the term of this patent is extended or adjusted under 35 U.S.C. 154(b) by 88 days.

(21) Appl. No.: 14/193,386

(22) Filed: Feb. 28, 2014

(65) Prior Publication Data

US 2015/0246771 A1 Sep. 3, 2015

(51) Int. Cl.
*G07F 7/06* (2006.01)

(52) U.S. Cl.
CPC ..... *G07F 7/06* (2013.01)

(58) Field of Classification Search
CPC ..... B65F 1/0033; B65F 1/006; B65F 1/004; B65F 1/085; B65F 2001/0086; B65F 2210/176; B65F 1/0066; B65D 21/02; B65D 21/0201; G07F 7/06
USPC ..... 232/43.1, 43.2; 220/23.2, 23.4, 908, 220/909, 23.88, 23.89; 248/346.03; 414/293
See application file for complete search history.

(56) References Cited

U.S. PATENT DOCUMENTS 4,573,641 A * 3/1986 DeWoolfson et al. ..... 241/36
4,653,627 A * 3/1987 Hampson et al. ..... 194/209
4,834,253 A * 5/1989 Crine ..... 220/23.4
4,874,111 A 10/1989 Heller
5,046,635 A 9/1991 Haas et al.
5,062,540 A * 11/1991 Jenkins ..... 220/23.83
5,101,997 A 4/1992 Bagwell et al.
5,355,987 A * 10/1994 DeWoolfson et al. ..... 194/209
5,435,445 A * 7/1995 Dellinger et al. ..... 209/576
5,630,493 A * 5/1997 DeWoolfson et al. ..... 194/209
6,024,240 A 2/2000 Howard et al.
6,047,843 A 4/2000 Mecke
6,186,308 B1 * 2/2001 Coyne et al. ..... 194/209
7,596,311 B2 * 9/2009 Saether et al. ..... 396/431
8,302,916 B2 * 11/2012 Dembowiak et al. ..... 248/95
8,851,265 B2 * 10/2014 Morishita et al. ..... 194/208

FOREIGN PATENT DOCUMENTS

WO WO 99/11525 A1 3/1999

* cited by examiner

*Primary Examiner* — William Miller
(74) *Attorney, Agent, or Firm* — Buchanan Ingersoll & Rooney P.C.

(57) ABSTRACT

A receptacle assembly for receiving empty containers includes a set of receptacles and a base. The base includes a guide adapted to control orientation of each receptacle in the set of receptacles when a receptacle is assembled on the base. When assembled on the base, each receptacle includes at least one inner side wall arranged adjacent to a side wall of another receptacle in the set of receptacles, and at least one outer side wall that does not face any side wall of a receptacle in the set of receptacles. The upper edge of a first inner side wall of a first receptacle extends downwards from a first intersection between the first inner side wall and one first outer side wall, to a point where the upper edge has a height which is lower than the height of any upper edge of each outer side wall of the first receptacle.

25 Claims, 9 Drawing Sheets

RECEPTACLE ASSEMBLY AND A REVERSE VENDING MACHINE COMPRISING SAID RECEPTACLE ASSEMBLY

TECHNICAL FIELD

The present disclosure relates to a receptacle assembly for receiving empty containers, comprising a set of receptacles and a base. The present disclosure also relates to a reverse vending machine comprising said receptacle assembly.

TECHNICAL BACKGROUND

In reverse vending machines normally standard rectangular bins are used to collect items, for example glass bottles or plastic bottles, which shall be recycled. The rectangular bins can weigh upwards of 150 lbs. each. When the reverse vending machine is full, i.e. the bin is full, the bin has to be emptied into a transport container, for example a barrel, or the bin is removed and replaced by another bin. The full bin will then be transported away, i.e. it will itself act as a transport container.

If the bin itself is used for transporting the collected material, full bins have to be stocked until the next scheduled transport. A sufficient amount of empty bins are needed, which can replace the full bins. This requires a lot of storage space. This is also costly and does not facilitate the maximization of the load on a standard route truck, since double stacking is not feasible.

The life time of the bins can also be reduced if, for example, crushed glass are being transported therein.

If, instead, the material in the bin shall be emptied into a larger barrel for the transport from the store to the recycling or processing facility, care has to be taken when handling a bin fully loaded with glass bottles as it is cumbersome and normally too heavy to lift for one person. This increases the potential for injury to the personnel handling the bins. Hence, instructions are normally given that the bin may not be fully loaded. This means that the bins have to be emptied more often and it is usually required that two persons lift and empty them. Alternatively, the contents is dumped onto the ground, and thereafter the glass is shoveled into the barrel which adds more safety, and cleanliness issues.

Because of the above, reverse vending machines are often placed out of service, until the collected material can be dealt with. Hence, the users of the reverse vending machines get the impression that the machines are broken and the user becomes less avenues to return their used products.

Consequently, there is a need to improve the above situation.

SUMMARY

The inventors have realized that by having a receptacle assembly comprising a base and a set of receptacles, where at least one of receptacles has a special designed opening, the empty containers which shall be recycled may e.g. be evenly distributed within the set of receptacles. The containers which shall be recycled may e.g. be used beverage containers and/or used food containers. The even distribution contributes to that it will be easier to lift, dump, and empty each receptacle into a barrel used by material recovery for transport.

The present disclosure relates to a receptacle assembly for receiving empty containers, comprising a set of receptacles and a base, said set of receptacles comprising at least a first receptacle and a second receptacle, and said base comprising guiding means adapted to control orientation of each receptacle in said set of receptacles when said set of receptacles is assembled on said base, each receptacle in said set of receptacles comprises a bottom and side walls, each sidewall having an upper edge, said receptacle assembly being adapted to be used in a reverse vending machine, and when assembled on said base each receptacle in said set of receptacles comprises at least one inner side wall and at least one outer side wall, wherein each inner side wall is arranged adjacent to a side wall of another receptacle in said set of receptacles, and each outer side wall is not facing any side wall of a receptacle in said set of receptacles, and a first inner side wall of the first receptacle in said set of receptacles is facing a first inner side wall of the second receptacle in said set of receptacles, wherein said upper edge of said first inner side wall of said first receptacle extends generally downwards from a first intersection, between said first inner side wall and one first outer side wall of said first receptacle, to a point where the upper edge has a height, relative to the bottom of said first receptacle, which is lower than a height of any upper edge, relative to the bottom, of each outer side wall of said first receptacle.

An arrangement like this enables that several receptacles can be used to collect the empty containers, such as glass bottles or plastic bottles, where previously one large container has been used. This makes it easier to empty the reverse vending machine when it is full. Naturally, crushed glass may be present in the receptacle, for example if a glass container is broken or cracked before being collected, or if it breaks when it lands in the receptacle, or if it is broken by another container landing on top of it, or if a crusher is used to break or compress some or all of the collected containers inside the receptacle in order to reduce the volume of the collected containers, etc. (the list is non exhaustive). However, the receptacle assembly can be used for any material, which shall be recycled and which is collected by a reverse vending machine.

By having at least one inner side wall, which is extending generally downwards from an intersection where the inner side wall intersects with an outer wall towards a point, where the height of the point, relative the base, is lower than the height of the upper edge of any of the outer side walls, a limiting side wall is accomplished, which may limit the load height of the receptacle When the material in the receptacle exceeds the upper edge, of the first inner side wall with one or a few empty containers, depending e.g. on the position of the container(s) relative the limiting side, they will fall over the upper edge. Some empty containers, especially in the middle of the receptacle, may pile up and not fall over the upper edge.

The upper edge of the first inner side wall is non-parallel to the bottom of the container, and may decrease along a straight line (i.e. at a predetermined angle) towards the bottom of the receptacle. Further, the upper edge does not necessarily decrease along a straight line (i.e. have a straight profile), but may have e.g. an undulated, stepped, curved or irregular profile when viewed from the side, as long as the upper edge is generally slanting downwards. In other words, as an alternative, the upper edge of the inner side wall may decrease stepwise.

The base with its guiding means may be used to reassure that the set of receptacles is arranged correctly on the base. The base can be used to capture liquid or commodity overflow which may occur when the receptacles are removed for dumping.

According to one example, the receptacle may be so arranged on the base that the upper edge of said first inner side wall is extending generally downwards to a centre point of the receptacle assembly, i.e. the centre point of the base.

According to at least one exemplary embodiment said set of receptacles comprises four receptacles. Alternatively, said set of receptacles may comprise two, three or more than four receptacles.

According to at least one exemplary embodiment said point is at a second intersection, between said first inner side wall and an adjacent inner side wall. This way the upper edge of the first inner side wall is extending downwards throughout the whole extension of the first inner side wall.

According to at least one exemplary embodiment said first receptacle further comprises a second inner side wall and said upper edge of said second inner side wall of said first receptacle extends generally downwards from a third intersection, between said second inner side wall and an outer side wall of said first receptacle, to said second intersection. If the first receptacles has two inner side walls they may have a similar shape. Having several receptacles instead of one large makes it possible for one person to lift and empty the receptacle into a larger container without having to carry the load of one full large container. Depending on size of the receptacle and the height, relative the bottom, of the upper edge at the second intersection or the height, relative the bottom at said point P (where the upper edge of the first side wall has a height, relative to the bottom, which is lower than the height of any upper edge, relative to the bottom, of each outer side wall of said first receptacle) the volume of the receptacle can be optimised. For example, the receptacle can be designed so that it is ensured the amount lifted at any one point in time is less than a predetermined value, for example 50 lbs.

If, for example, the receptacle should be designed to hold about 50 lbs. of glass bottles collected therein a corresponding or suitable inner volume of the container may be calculated. As an example a volume around 3,000 cubic inches, and a base area of e.g. around 144 square inches, are normally suitable when it is desired not to exceed a weight of 50 lbs. when glass bottles are collected therein. If the receptacle has a base area of 144 square inches then the height at the second intersection may be e.g. 16 inches. In general, when glass bottles shall be collected in the receptacle the base area of the receptacle is e.g. 144+/−20 square inches or e.g. 144+/−10 square inches and the height, relative the base, at the second intersection or at point P is e.g. 16+/−20 inches or e.g. 16+/−10 inches.

According to at least one exemplary embodiment the upper edge of said first outer side wall of said first receptacle extends generally downwards towards said first intersection.

According to at least one exemplary embodiment the upper edge of said first outer side wall of said first receptacle extends generally downwards from a fourth intersection, between said first outer side wall and a second outer side wall of said first receptacle to said first intersection.

This way one outer side wall may be slanting at an angle towards the base. Alternatively, it may extend downwards stepwise. The upper edge does not necessarily have a straight profile, but may have e.g. an undulated, stepped, curved or irregular profile when viewed from the side, as long as it is generally slanting downwards.

According to at least one exemplary embodiment wherein the upper edge of said second outer side wall of said first receptacle extends generally downwards from said fourth intersection to said third intersection. This way the second outer side wall may also be slanting in an angle towards the base. Alternatively, it may extend downwards stepwise. The upper edge does not necessarily have a straight profile, but may have e.g. an undulated, stepped, curved or irregular profile when viewed from the side, as long as it is generally slanting downwards.

The downwardly extending outer side walls, i.e. the first outer side wall and/or the second outer side wall may allow, when the receptacle assembly is arranged in a reverse vending machine, that a photocell beam travels across the receptacle assembly. The beam may be used to determine if the receptacle assembly is sufficiently full to be emptied.

Further, the upper edges of the outer side walls, which are higher, relative the base than the height, relative the bottom, of the upper edges of the inner side walls may form together with the outer walls a guiding surface, which may guide the material collected in the receptacle when dumping it for example into larger container.

According to at least one exemplary embodiment said downwards extending upper edge of said first inner side wall of said first receptacle extends downwards towards a centre point of said receptacle assembly when at least said first receptacle is assembled on said base.

According to at least one exemplary embodiment a height of said upper edge of said first inner side wall of said second receptacle, relative to the bottom of said first receptacle, is the same as the height of said upper edge of said first inner side wall of said first receptacle throughout the whole length of said upper edge of said first inner side wall of said first receptacle.

This way two inner side walls, which are arranged adjacent to and facing each other, have the same height, i.e. the upper edges runs in parallel, adjacent each other. If, for example, all the material which is received by the reverse vending machine, by coincident, is falling into the first receptacle, the first receptacle will naturally be the receptacle which first is full. The gradually decreasing inner side walls of the first receptacle and the second receptacle will ensure that when the first receptacle is filled up to at least the lowest point, i.e. where the first side wall is lowest, the material will start tipping over into the second receptacle, in at least that area, until the second receptacle is full.

According to at least one exemplary embodiment all receptacles in said set of receptacles are identical. By having identical receptacles the same manufacturing tool(s) may be used to manufacture them. Further, the receptacle assembly will get a specially designed opening.

According to at least one exemplary embodiment said base comprises a base bottom and base side walls, enclosing said base bottom, and when said set of receptacles are assembled on said base, said base side walls are adjacent the outer walls of each receptacle in said set of receptacles.

By having base side walls enclosing the set of receptacles when the set of receptacles is arranged on the base, the position of the set of receptacles is restrained. The receptacles can for example not accidently slide of the base if the receptacle assembly is being moved. Further, the base can capture liquid and commodity overflow which may occur when the receptacles are removed for dumping.

According to at least one exemplary embodiment the height of said base side wall, relative the base bottom of said base, is lower than the lowest height, relative the bottom, of the upper edge of each outer side wall of said first receptacle. The "the lowest height, relative the bottom, of the upper edge of each outer side wall of said first receptacle" may also be referred to as "the lowest height of the opening" below. Further, the height of the base wall may be smaller than half the lowest height of the opening. Further, the height of the base wall may be between one quarter and half the lowest height of the opening. Further, the height of the base wall may be between 1 inch and a quarter of the lowest height of the opening. A lower height of the base facilitates the lifting of the containers, as well as the handling e.g. cleaning of the base.

According to at least one exemplary embodiment at least one of said base side walls may have a slot. The slot may be used as a handle, which facilitates the person using the receptacle assembly to grab the base and remove it.

According to at least one exemplary embodiment said base comprises a base bottom and said guiding means of said base is integrated with said base bottom and interacts with a matching guiding means on a respective receptacle of said set of receptacles when said set of receptacles is arranged on said base. Guiding means ensure that the receptacles are properly positioned within the base. Hence it is ensured that a receptacle can only be positioned on the base in one way.

According to at least one exemplary embodiment said guiding means of said base protrudes from said base bottom. If the guiding means are protruding from the base bottom, they can be made in one piece with the base bottom.

According to at least one exemplary embodiment said guiding means are recesses in said base bottom and each receptacle has protrusions, which fits into said recesses. This may be an alternative solution to guiding means which protrudes from the base bottom.

According to at least one exemplary embodiment at least one of said upper edges of said outer side walls of said first receptacle is parallel with the bottom of said first receptacle.

According to at least one exemplary embodiment at least said first receptacle comprises at least one handle. By having at least one handle the receptacle can easier be removed from the base, in order to be emptied.

According to at least one exemplary embodiment at least said first receptacle comprises a handle which is integrated with said at least one inner side wall proximate to said bottom of said first receptacle. The handle may help the user when emptying the receptacle.

According to at least one exemplary embodiment at least said first receptacle comprises at least one handle which is integrated in said at least one outer side wall proximate to the upper edge of the at least one outer side wall.

By having a handle at the upper part of the receptacle the receptacle is easier to remove from the tray and to carry away.

According to at least one exemplary embodiment said handle is a recess in said outer side wall. According to one example, said recess is not a through hole. A recess which is not a through hole has the advantage of protecting the hand of the user if the receptacle is full with sharp materials, such as crushed glass.

According to at least one exemplary embodiment the base comprises a base bottom and said guiding means of said base protrudes from said base bottom, at least one of said first receptacle and said second receptacle comprises a handle which is integrated in said at least one inner side wall and forms part of an underside of the bottom of said at least one of said first receptacle and said second receptacle. Said handle forms guiding means which is mutually matching with said guiding means on said base, such that when said at least one of said first receptacle and said second receptacle comprising said handle is arranged on said base said handle integrates with said guiding means on said base.

This way, the handle is used as a guiding means. No extra guiding means are necessary on the receptacle.

According to at least one exemplary embodiment said receptacle comprises a guiding recess on said at least one outer side walls. The guiding recess may be arranged on the corner, which is between the first and the second outer side wall, on the outside of said first receptacle. The guiding recess assists the user in carrying, handling, and dumping the contents of the receptacle into a larger container. The user would hold the receptacle by a handle, if the receptacle has one, using their dominant hand and place their other hand into the guiding recess designed to assist their grip on the receptacle and to act as a pivot point, controlling the tip, when the receptacle is being emptied.

According to at least one exemplary embodiment said receptacle assembly is arranged on a trolley. The trolley with the receptacle assembly can be inserted into the reverse vending machine, so when the machine, i.e. the receptacles, is full the trolley can be removed and pushed to the container where the receptacles can be emptied.

According to another aspect of the present disclosure, a reverse vending machine is provided. The reverse vending machine comprises a receptacle assembly for receiving empty containers, which containers have been inserted through an inlet of said reverse vending machine, said receptacle assembly is arranged under a common outlet, through which said inserted empty containers come out of after being inserted into said inlet of said reverse vending machine, said receptacle assembly comprises a set of receptacles and a base, said set of receptacles comprising at least a first receptacle and a second receptacle, and said base comprising guiding means adapted to control orientation of each receptacle in said set of receptacles when said set of receptacles is assembled on said base, each receptacle in said set of receptacles comprises a bottom and side walls, each sidewall having an upper edge, said receptacle assembly being adapted to be used in a reverse vending machine, and when assembled on said base each receptacle in said set of receptacles comprises at least one inner side wall and at least one outer side wall, each inner side wall being arranged adjacent to a side wall of another receptacle in said set of receptacles, and each outer side wall is not facing any side wall of a receptacle in said set of receptacles, and a first inner side wall of the first receptacle in said set of receptacles is facing a first inner side wall of the second receptacle in said set of receptacles, wherein said upper edge of said first inner side wall of said first receptacle extends generally downwards from a first intersection, between said first inner side wall and one first outer side wall of the first receptacle, to a point where the upper edge has a height, relative to the bottom of the first receptacle, which is lower than a height of any upper edge, relative to the bottom, of each outer side wall of said first receptacle.

The reverse vending machine may be a reverse vending machine where the receptacle assembly is arranged into the reverse vending machine from the front, i.e. where the user inserts the material to be recycled. In another alternative the receptacle assembly is arranged into the reverse vending machine from the back of the machine. In these two variants the receptacle assembly is normally arranged relatively close to the inlet. In another alternative the receptacle assembly can be used in a reverse vending machine having a backroom solution, i.e. the receptacle assembly is arranged at a larger distance from the inlet than in the ones described above. For example, the empty containers are inserted through inlet, but before the empty containers are collected in the receptacle assembly they may be transported on an assembly line in order to be sorted before they arrive to the receptacle assembly.

The features related to the receptacle assembly described before, relates also to the receptacle assembly comprised in the reverse vending machine and will hence not be described again.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise.

Other objectives, features and advantages of the present disclosure will appear from the following detailed disclosure, as well as from the drawings.

BRIEF DESCRIPTION OF THE DRAWINGS

The above, as well as additional objects, features and advantages of the present disclosure, will be better understood through the following illustrative and non-limiting detailed description of exemplary embodiments of the present disclosure, with reference to the appended drawings, where the same reference numerals will be used for similar elements, wherein.

All the figures are highly schematic, not necessarily to scale, and they show only parts which are pertinent in order to elucidate the present disclosure, other parts being omitted or merely suggested.

DETAILED DESCRIPTION OF EXEMPLARY EMBODIMENTS

Embodiments of the present disclosure will be described in more detail in the following with reference to the accompanying drawings.

Figure 1:
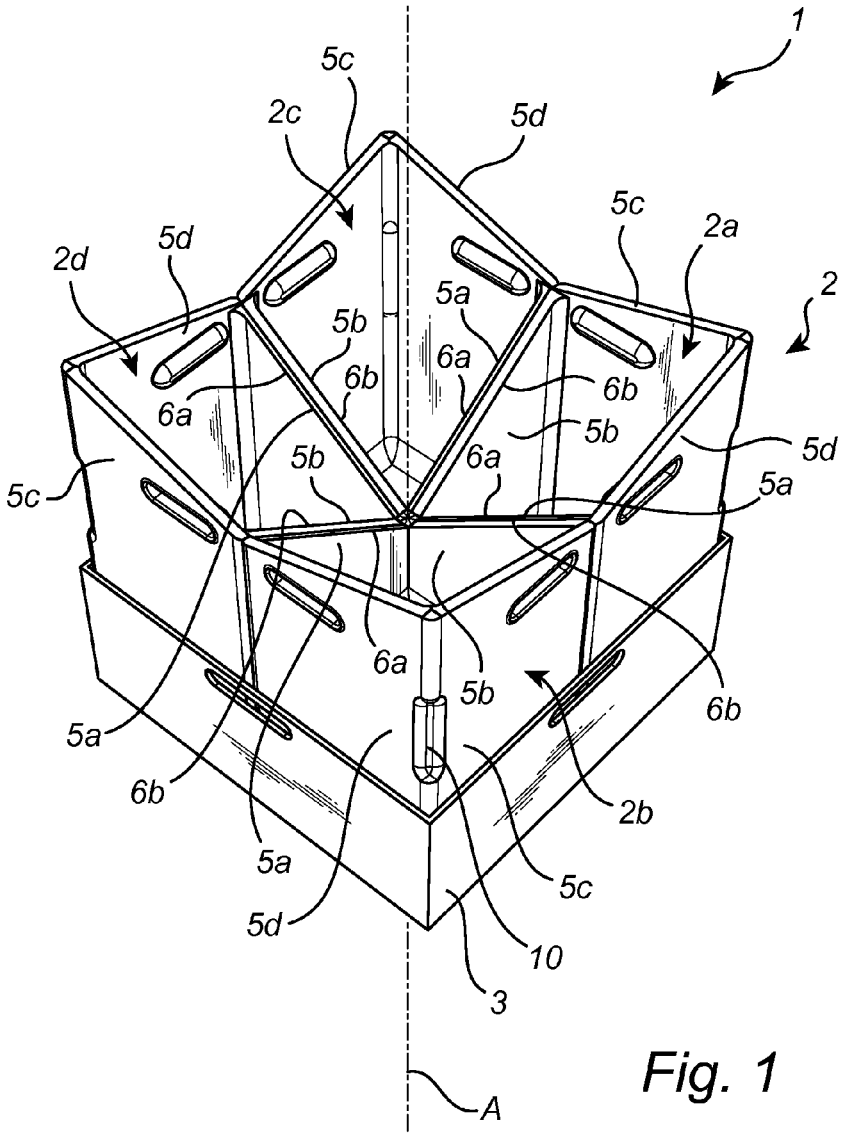
FIG. 1 shows a receptacle assembly in perspective according to a first embodiment.

FIG. 1 shows a receptacle assembly 1, which is used in a reverse vending machine (not shown) in order to collect empty containers, which shall be recycled, for example glass bottles or plastic bottles. The receptacle assembly 1 comprises a set of receptacles 2. Here exemplified as four receptacles, a first receptacle 2*a*, a second receptacle 2*b*, a third receptacle 2*c* and a fourth receptacle 2*d*. The receptacles are arranged on a base 3.

All four receptacles 2*a*, 2*b*, 2*c*, 2*d* are identical. They may, however, be different. Each receptacle 2*a*, 2*b*, 2*c*, 2*d*, comprises two inner side walls 5*a*, 5*b* and two outer side walls 5*c*, 5*d*, which will be further explained in regard to FIG. 2. Each inner side wall 5*a*, 5*b* is being arranged adjacent to an inner side wall 5*b*, 5*a* of another receptacle in said set of receptacles 2 and each outer side wall 5*c*, 5*d* is not facing any side wall of a receptacle in said set of receptacles. Each side wall 2*a*, 2*b*, 2*c*, 2*c* has an upper edge. The upper edges 6*a*, 6*b* of the inner side walls 5*a*, 5*b* are extending downwards to a centre point A of the receptacle assembly 1, when arranged on the base 3.

Figure 2:
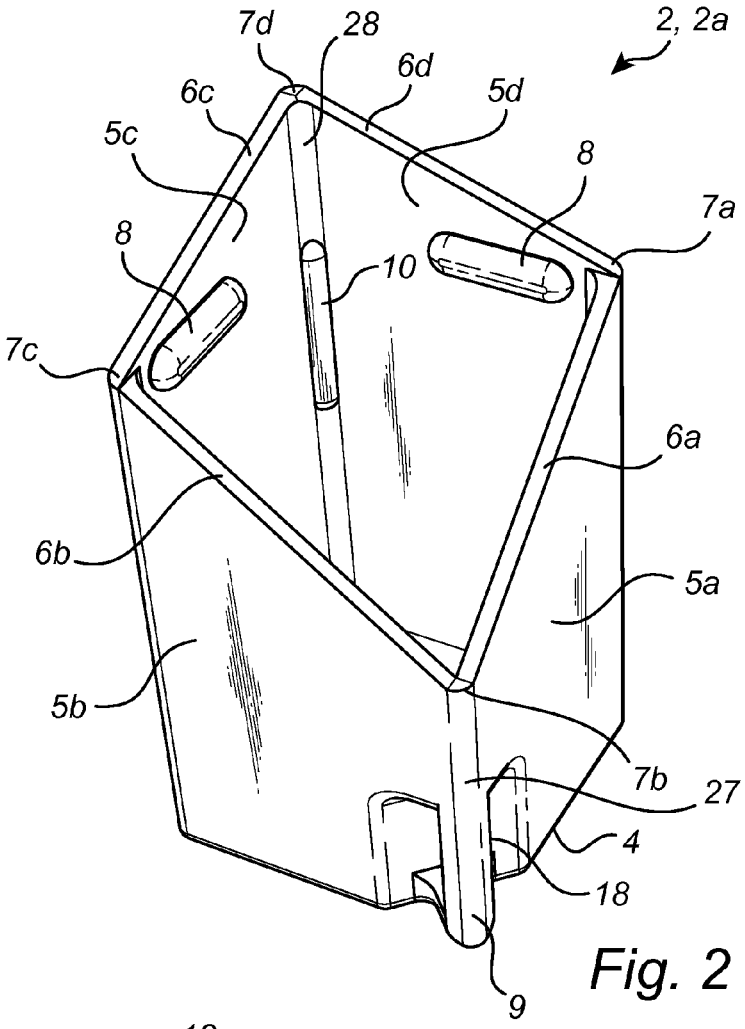
FIG. 2 shows one receptacle shown in FIG. 1 in perspective.

FIG. 2 shows the first receptacle 2*a* in FIG. 1. The other receptacles 2*b*, 2*c*, 2*c* are identical; hence the first receptacle 2*a* will be referred to as the receptacle 2.

The receptacle 2 comprises a bottom 4 and four side walls 5*a*, 5*b*, 5*c*, 5*d*. Each side wall 5*a*, 5*b*, 5*c*, 5*d* comprises a respective upper edge 6*a*, 6*b*, 6*c*, 6*d*. Two of the side walls 5*a*, 5*b* when arranged on the base 3 in FIG. 1 are arranged adjacent to a side wall of another receptacle 2*b*, 2*c*, or 2*d* (see FIG. 1). These two side walls 5*a*, 5*b*, which are facing another receptacle when arranged on the base will be referred to as the first inner side wall 5*a* and the second inner side wall 5*b*. The two inner side walls 5*a*, 5*b* have the same configuration, i.e. they are mirror images of each other. The lower edge of each inner side wall may e.g. have a length which is about 12 inches, or between 11-13 inches, or between 10-15 inches. The other two side walls 5*c*, 5*d*, which are not facing any side wall of a receptacle when arranged on the base, will be referred to as the first outer side wall 5*d* and the second outer side wall 5*c*. The two outer side walls 5*c*, 5*d* have the same configuration, i.e. they are mirror images of each other. The lower edge of each outer side wall may e.g. have a length which is about 12 inches, or between 11-13 inches, or between 10-15 inches. According to one example, both the inner sidewalls and the outer side walls of the receptacle is about 12 inches, such that the base area of the receptacle is about 144 square inches. The first inner side wall 5*a* will now be described. The upper edge 6*a* of the first inner side wall 5*a* is extending generally downwards from a first intersection 7*a*, which is an intersection between the first inner side wall 5*a* and the first outer wall 5*d*, towards a point, which here is at a second intersection 7*b*. The second intersection 7*b* is between the first inner side wall 5*a* and the second inner side wall 5*b*. At this point, i.e. at the second intersection 7*b*, the upper edge 6*a* of the first inner side wall 5*a* has a height, relative the bottom of the container, which is lower than the height of the upper edges 6*c*, 6*d* of the outer side walls 5*c*, 5*d*. Between the first inner side wall 5*a* and the second inner side wall 5*b* is a corner 27. This corner is as an inner corner 27 when the receptacles are arranged on the base, i.e. this corner is arranged towards the centre of the receptacle assembly. The upper edge of the first inner side wall 5*a* may for example have height, relative the bottom, at the first intersection 7*a* which is about 21 inches, for example 21+/−10 inches, or e.g. 21+/−5 inches, when glass bottles shall be collected therein. The upper edge of the first inner side wall 5*a* may for example have height, relative the bottom at the second intersection 7*b* which is about 16 inches, for example 16+/−10 inches, or e.g. 16+/−5 inches.

The second inner side wall 5*b* has a similar upper edge 6*b*, as the first inner side wall. The upper edge 6*d* of the second inner side wall 5*b* extends generally downwards from a third intersection 7*c*, which is an intersection between the second inner side wall 5*b* and the second outer side wall 5*c*, towards the second intersection 7*b* between the first inner side wall 5*a* and the second inner side wall 5*b*. The upper edges 6*a*, 6*b* of the first inner side wall 5*a* and the second inner side wall 5*b* are extending downwards at the same angle and the heights of the upper edges, relative the bottom, at the first intersection 7*a* and the third intersection 7*c* are the same. The upper edge of the second inner side wall 5*b* may for example have height, relative the bottom, at the third intersection 7*c* which is about 21 inches, for example 21+/−10 inches, or more e.g. 21+/−5 inches, when glass bottles shall be collected therein. The upper edge of the second inner side wall 5*b* has the same height, relative the bottom, at the second intersection 7*b* as explained above, which is about 16 inches, for example 16+/−10 inches, or e.g. 16+/−5 inches, when glass bottles shall be collected therein. The first outer wall 5*d* will now be described. The upper edge 6*d* of the first outer wall 5*d* is extending generally downwards from a fourth intersection 7*d*, which is an intersection between the first outer wall 5*d* and the second outer wall 5*c*, to the first intersection 7*a*. The upper edge of the first outer side wall 5*d* may for example have height, relative the bottom, at the fourth intersection 7*d* which is about 24 inches, for example 24+/−10 inches, or more e.g. 24+/−5 inches. The upper edge of the first outer side wall 5*d* may then have a height, relative the bottom, at the first intersection 7*a*, which stated above, about 21 inches, for example 21+/−10 inches, or e.g. 21+/−5 inches.

The second outer side wall 5*c* is extending downwards from the fourth intersection 7*d* to the third intersection 7*c*. The upper edge 6*c* of the second outer side wall 5*c* will then have the same height, relative the bottom, at the fourth intersection 7*d* which is about 24 inches, for example 24+/−10 inches, or e.g. 24+/−5 inches, when glass bottles shall be collected therein. The upper edge of the second outer side wall 5*c* may then have a height, relative the bottom, a the third intersection 7*c*, as stated above, about 21 inches, for example 21+/−10 inches, or e.g. 21+/−5 inches.

Between the first outer side wall 5*d* and the second outer side wall 5*c* is a corner 28. This corner is as an outer corner 28 when the receptacles are arranged on the base, i.e. this corner is arranged away from the centre of the receptacle assembly 1.

The upper edges 6*c*, 6*d* of the outer side walls 5*c*, 5*d* are extending downwards from the common intersection 7*d* at the same angle and the heights of the upper edges, relative the bottom, are the same throughout the extension of the outer side walls.

The height relative the bottom at the second intersection 7*b* is the lowest height of the upper edges of the first receptacle and depending on the height the volume of the receptacle 2 can be predetermined. For example, the receptacle can be designed so that it is ensured the amount lifted at any one point in time is less than a predetermined value, for example 50 lbs. The volume may be about 3,000 cubic inches, and the receptacle may be, e.g., suitable for holding a glass volume corresponding to 50 lbs. It is noted however, that the volume of the glass may be related to whether the glass is crushed or not, and when the receptacle is collected some of the containers may be crushed and others are not. As a general rule a thumb, 100 glass bottles normally weighs about 50 lbs. In one embodiment, the receptacle may have an air volume of about 3,000 cubic inches and may be used for collecting about 100 bottles, some of them being crushed.

The opening of the receptacle 2 is, hence, slanting from the outer corner 28, which is between the first and the second outer side walls 5*c*, 5*d*, downwards to the inner corner 27, which is between the two inner side walls 5*a*, 5*b*.

The downwardly extending outer walls 5*c*, 5*d* allows that a photocell beam travels across the assembly, e.g. first along and above two adjacent parallel inners sides 5*a*, 5*b* of a first pair of containers 2*a*, 2*b* and thereafter along and above two adjacent parallel inners sides 5*b*, 5*a* of a second pair of containers 2*c*, 2*d*, to determine if the receptacle assembly is full when the receptacle assembly in FIG. 1 is arranged in a reverse vending machine. As the receptacles 2, 2*a*, 2*b*, 2*c*, 2*d* are removed from the base 3, see FIG. 1, they allow the material stored in the receptacles to settle towards the higher ends, preventing unintended spilling of the contents.

The receptacle 2 has two upper handles 8. One is arranged on the first outer side wall 5*d* close to the upper edge 6*d* and the other is arranged on the second outer side wall 5*c* close to the upper edge 6*c*. These upper handles 8 enable the receptacle 2 to be lifted up from the base 3 in FIG. 1 and carried away.

The receptacle 2 has an integrated handle 9, which is adjacent to the bottom 4 of the receptacle 2 and the handle 9 is part of the first and the second inner side walls 5*a*, 5*b*. That is, the handle 9 is part of the corner 27 between the first and the second inner side walls 5*a*, 5*b*. At the area of the handle 9 the inner side walls 5*a*, 5*b* each have a recess or opening 18 which is enclosed by the handle 9. The opening 18 may enable a hand to be inserted in the opening 18 so that a hand can grip around the handle 9. This handle 9 can be used after the receptacle has been removed from the tray and shall be emptied into a larger container.

The receptacle 2 also has a guiding recess 10 on the outside arranged in the corner 28 between the first and the second outer side wall (see also FIG. 1). The guiding recess 10 assists the user in carrying, handling, and dumping the contents of the receptacle into a larger container. The user may hold the receptacle 2 by the handle 9 using their dominant hand and place their other hand into the guiding recess 10 designed to assist their grip on the receptacle 2 and to act as a pivot point, controlling the tip, when the receptacle 2 is being emptied.

The receptacles 2*a*, 2*b*, 2*c*, 2*d* when arranged on the base 3, see FIG. 1, create together a common opening for the set of receptacles in order to receive the material which shall be recycled. The inner side walls 5*a*, 5*b* of each receptacle may act together as a guide to ensure relatively even distribution of the empty containers which have been inserted into the reverse vending machine. This facilitates that the weight of each receptacle is capable of being handled, lifted and dumped by a single person.

The receptacle 2 can be made by for example, plastic or aluminum. However any suitable material can be used.

Figure 3:
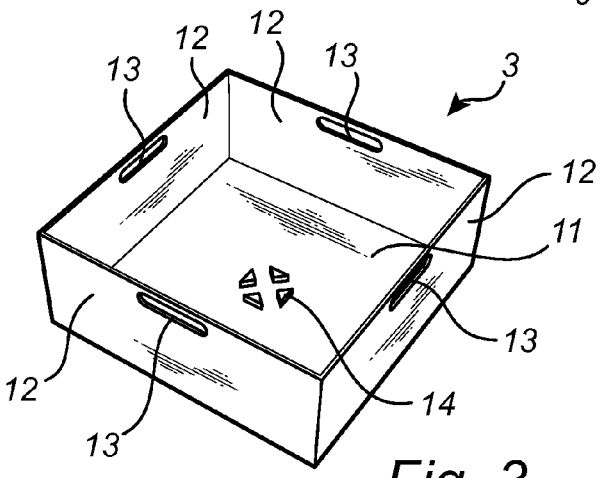
FIG. 3 shows the base in FIG. 1 in perspective.

FIG. 3 shows the base 3 for the set of receptacles 2. The base 3 has a base bottom 11 and four base side walls 12. The base side walls 12 are slightly larger than the outer walls of the set of receptacles 2, when they are arranged on the base 3. The base 3 can be seen as a vessel to capture for example broken glass or empty containers when the receptacles 2 are manually removed for dumping. The base side walls 12 are lower than the outer side walls of the receptacles 5*c*, 5*d*. The base 3 may also act as a frame to hold the receptacles in place and it may assure proper placement of the receptacles within it. The base 3 can be made of aluminum, steel, or plastic. However, any suitable material may be used.

Each base side wall 12 has a base handle 13, which is exemplified as an opening, however it may also be a recess. The base handle 13 allows a person to lift the base 3 to empty any material, for example glass, that may have spilled into the base while removing the receptacles 2. This allows for a cleaner and safer experience for the person handling the system.

Figure 4A:
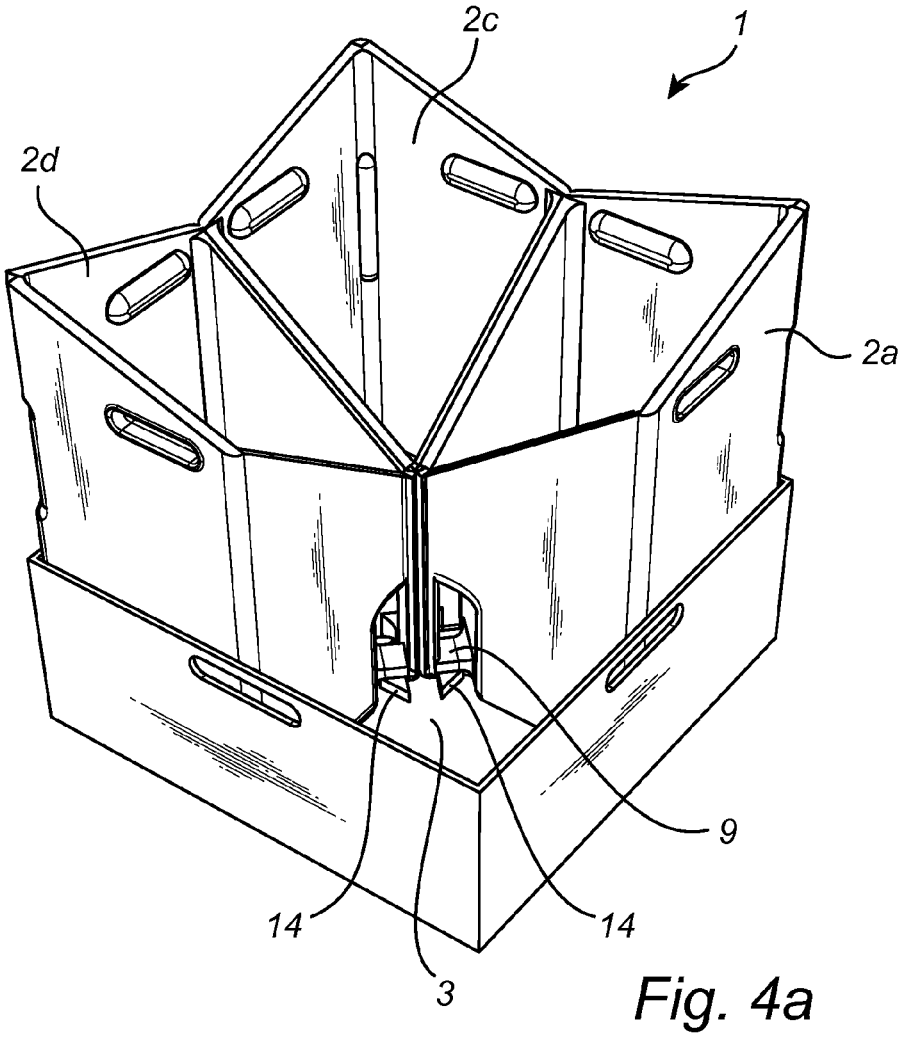
FIG. 4*a* shows the receptacle assembly in FIG. 1 with only three receptacles arranged on the base in order to see the guiding means.
Figure 4B:
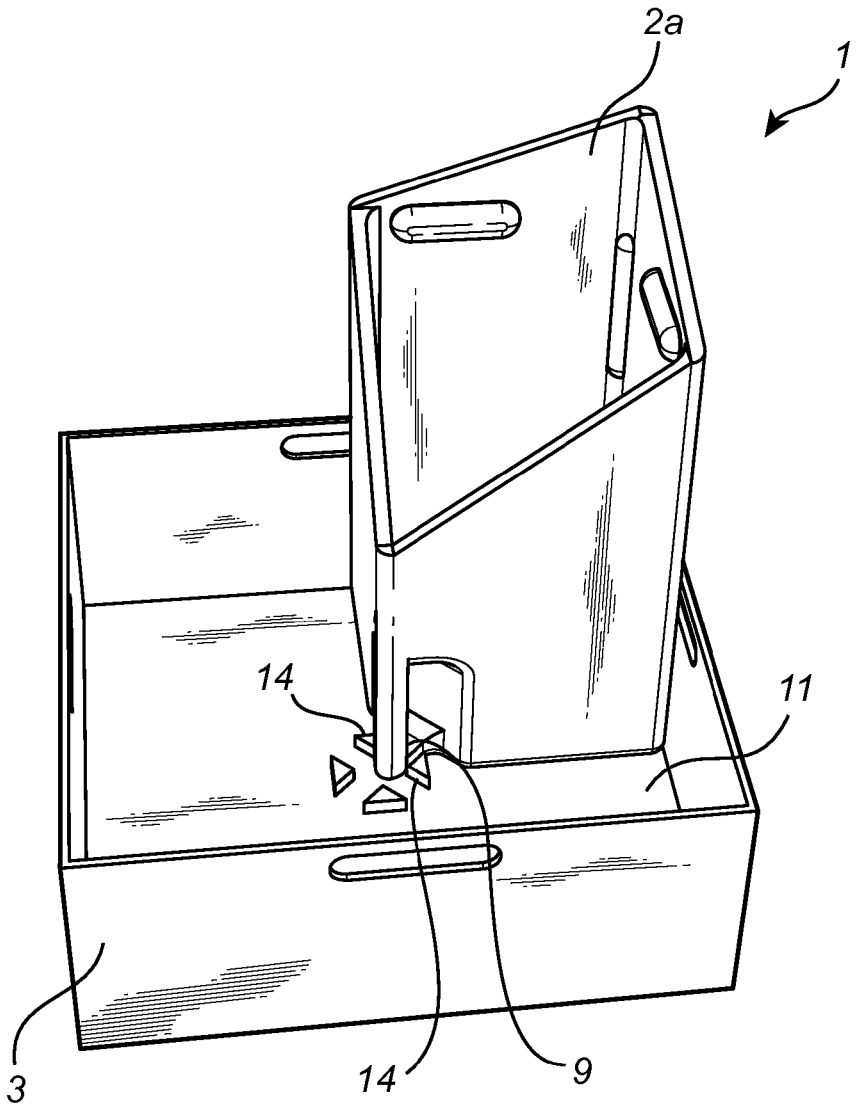
FIG. 4*b* shows the receptacle assembly in FIG. 1 with only one receptacle arranged on the base in order to see the guiding means.

The base 3 has on the base bottom 11 guiding means 14 that are protruding from the base bottom 11. The guiding means 14 are four protrusions each having a triangular shape. Each triangle is arranged close to the centre of the base, with one side parallel with a respective base side wall 12. The triangles are arranged at a distance from each other, which distance is slightly larger than the width of one handle 9 close to the bottom of a receptacle, so that the handle 9 can be arranged between two triangular protrusions. The guiding means 14 are not limited to have a triangular shape, they may have any shape suitable, which interacts with the handle. When the set of receptacles 2 is arranged on the base 3 each handle 9 of each receptacle 2*a*, 2*b*, 2*c*, 2*d* will be arrange between two triangles 14. This is shown in FIGS. 4*a* and 4*b*. FIG. 4*a* shows the receptacle assembly 1 with only three receptacles 2*a*, 2*b*, 2*d* arranged on the base 3, where each handle 9 of the receptacles 2*a*, 2*b*, 2*d* is arranged between two triangular guiding means 14 protruding from the base bottom 11. FIG. 4*b* shows the receptacle assembly 1 with only one receptacle 2*a* arranged on the base. The handle 9 close to the bottom of the receptacle 2*a* is arranged between two of the four guiding elements 14.

In use the four receptacles 2*a*, 2*b*, 2*c*, 2*d* will nest into the base, and the guiding means 14 may ensure that insertion into the base 3 can only be accommodated in the correct orientation.

Figure 5:
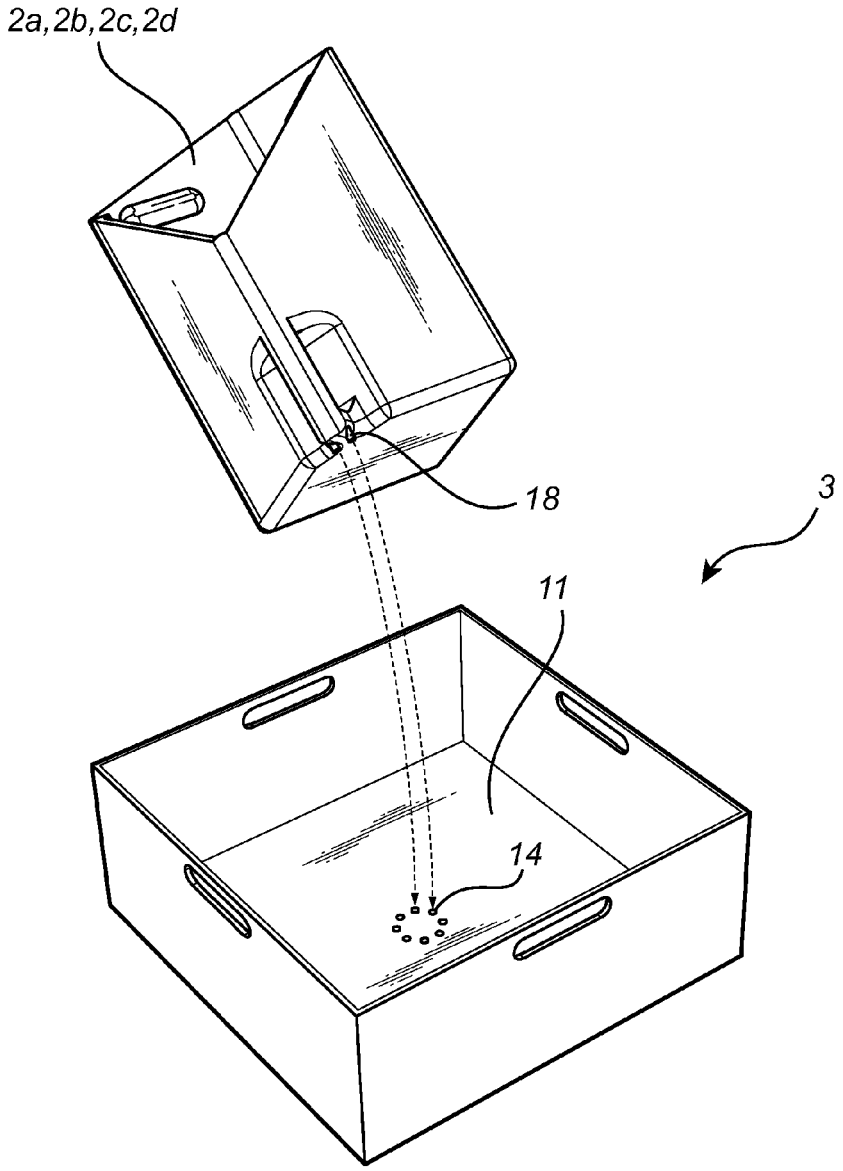
FIG. 5 shows the base shown in FIG. 3 with alternative guiding means together with the receptacle in FIG. 2 with matching alternative guiding means in an exploded view.

FIG. 5 shows the base 3 in FIG. 1 with guiding means 14 in shape of holes in the base bottom 11 of the base and a receptacle 2*a*, 2*b*, 2*c*, 2*d* having matching guiding means 18 in shape of pins 18. The pins are protruding out of the underside of the bottom of the receptacle 2*a*, 2*b*, 2*c*, 2*d* and they mutually match into the holes 14 on the base 3 when the receptacle is arranged on the base 3.

Figure 6:
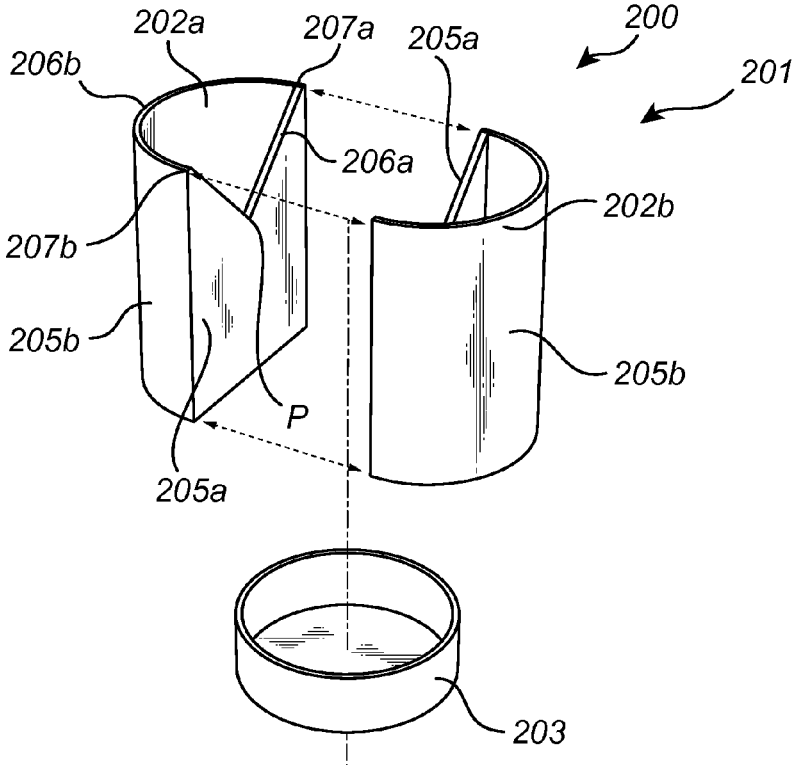
FIG. 6 shows a receptacle assembly according to a second embodiment in an exploded view.

FIG. 6 shows a set of receptacles 200 comprising two identical receptacles 202*a*, 202*b*, which together when arranged on a base 203 forms a receptacle assembly 201. One of the receptacles will now be described. The receptacle 202*a* has an inner side wall 205*a*, which will be arranged against an inner side wall 205*a* of the second receptacle 202*b*. The receptacle 202*a* also has a rounded outer side wall 205*b*. The upper edge 206*a* of the inner side wall 205*a* is extending downwards from a first intersection 207*a*, which is between the inner side wall 205*a* and the outer side wall 205*b* towards a point P. At the point P the height, relative the bottom, of the receptacle 202*a* is lower than the height of the upper edge 206*b*, relative the bottom, of the outer side wall 205*b*. The upper edge 206*a* of the inner side wall 205*a* is extending upwards from point P to a second intersection 207*b*, which is between the inner side wall 205*a* and the other end of the outer side wall 205*b*. The upper edge 206*a* of the inner side wall 205*a* will hence have a V-shape, it may also have a U-shape. The upper edge 206*b* of the outer side wall 205*b* is exemplified as being parallel to the base of the receptacle, it may however be generally slanting downwards towards the first intersection 207*a* and the second intersection 207*b*.

Figure 7:
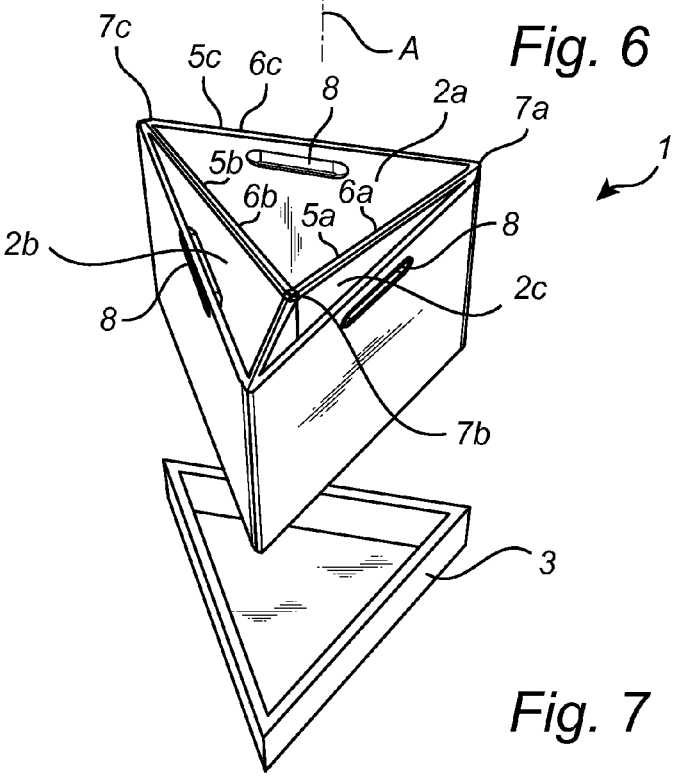
FIG. 7 shows a receptacle assembly according to a third embodiment in an exploded view.

FIG. 7 shows a receptacle assembly 1 similar to the one described in FIG. 1, however with only three receptacles 2*a*, 2*b*, 2*c*, in the set of receptacles 2 and arranged on a triangular base 3. The first receptacle 2*a* will now be described, and the other two receptacles are identical. Receptacle 2*a* comprises a bottom and three side walls 5*a*, 5*b*, 5*c*. Each side wall 5*a*, 5*b*, 5*c* comprises a respective upper edge 6*a*, 6*b*, 6*c*. Two of the side walls 5*a*, 5*b* when arranged on the base 3 are arranged adjacent to a side wall of another receptacle 2*b*, 2*c*. These two side walls 5*a*, 5*b*, which are facing another receptacle when arranged on the base will be referred to as the first inner side wall 5*a* and the second inner side wall 5*b*. The two inner side walls 5*a*, 5*b* have the same configuration, i.e. they are mirror images of each other. The other side wall 5*c*, which is not facing any side wall of a receptacle when arranged on the base, will be referred to as the outer side wall 5*c*. The first inner side wall 5*a* will now be described. The upper edge 6*a* of the first inner side wall 5*a* is extending generally downwards from a first intersection 7*a*, which is between the first inner side wall 5*a* and the outer side wall 5*c*, towards a point, which here is at a second intersection 7*b*. The second intersection 7*b* is between the first inner side wall 5*a* and the second inner side wall 5*b*. At this point, i.e. at the second intersection 7*b*, the upper edge 6*a* of the first inner side wall 5*a* has a height, relative the bottom, which is lower than the height of the upper edge 6*c*, relative the bottom, of the outer side wall 5*c*.

The second inner side wall 5*b* has a similar upper edge 6*b*. The upper edge 6*b* of the second inner side wall 5*b* extends generally downwards from a third intersection 7*c*, which is between the second inner side wall 5*b* and the outer side wall 5*c*, towards the second intersection 7*b* between the first inner side wall 5*a* and the second inner side wall 5*b*. The upper edges 6*a*, 6*b* of the first inner side wall 5*a* and the second inner side wall 5*b* are extending downwards at the same angel and the heights of the upper edges, relative the bottom, at the first intersection 7*a* and the third intersection 7*c* are the same.

The upper edge 6*c* of the outer side wall 5*d* is extending generally parallel with the base bottom 4 between the first intersection 7*a* and the third intersection 7*c*. The receptacle assembly may also have the other features described in regard to FIG. 1. In FIG. 7 the receptacles have upper handles 8 arrange on the outer side wall 6*c*.

Figure 8:
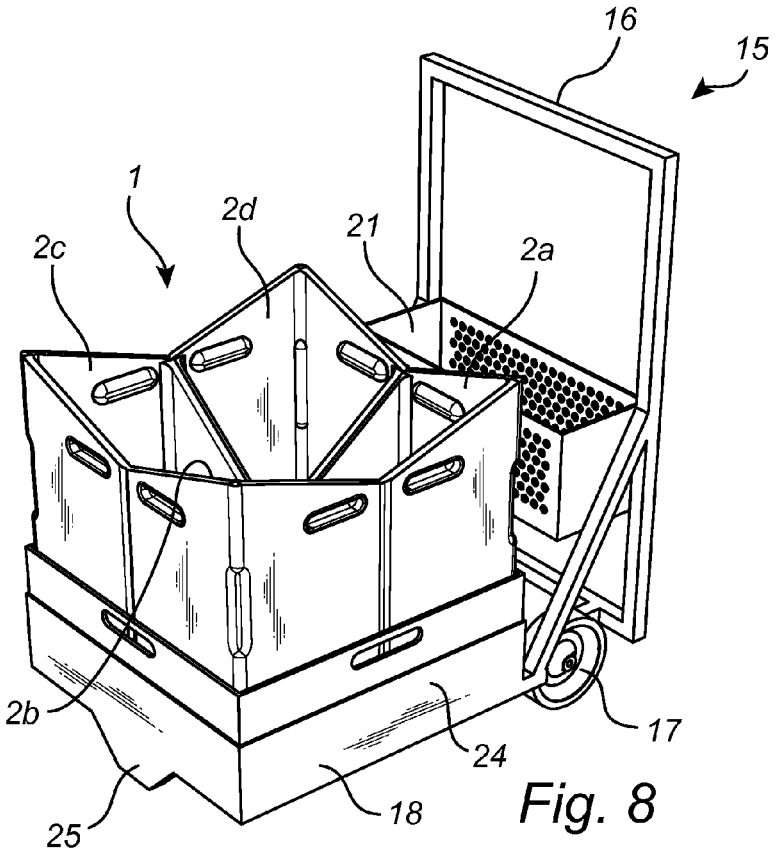
FIG. 8 shows the receptacle assembly in FIG. 1 arranged on a trolley.
Figure 9:
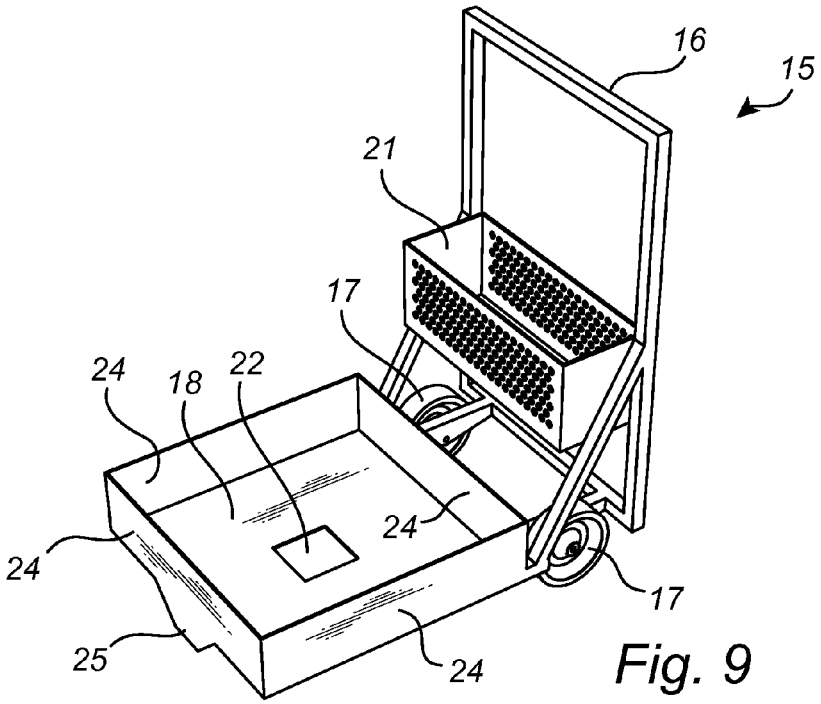
FIG. 9 shows the trolley in FIG. 8 without the receptacle assembly in FIG. 1.

FIG. 8 shows a trolley 15 with a receptacle assembly 1 arranged thereon. FIG. 9 shows the trolley 15 without the receptacle assembly 1. FIG. 8 and FIG. 9 will be described together. The trolley 15 with the receptacle assembly 1 can be inserted into the reverse vending machine, so when the machine, i.e. the receptacles, is full the trolley 15, with the receptacle assembly still on it, can be removed and pushed to the container where the receptacles 2*a*, 2*b*, 2*c*, 2*d* can be emptied.

The trolley 15 comprises a trolley handle 16, two wheels 17 and a receptacle assembly receiving area 18. The two wheels 17 assist the person using the trolley 15 to maneuver and carry the entire weight of the receptacle assembly 1 and its content. The wheels 17 may be oversized and they are normally flush with the sides of the trolley to allow maximization of capacity within the reverse vending machine. The handle 16 comprises a basket 21 to house for example a brush and a dustpan. The handle may have any suitable shape and it may have no basket arranged to it or it could be only one as shown, or it may be several. The trolley is also not limited to have only two wheels. It may have three or more.

The receptacle assembly receiving area 18 is a platform on which the receptacle assembly 1 can be arranged. The receptacle assembly receiving area 18 provides a solid surface for the base 3 and the set of receptacles 2 to rest on, and there may be a hole 22 in the bottom to allow cleaning, and sweeping of the trolley 15 if debris would fall into it. The receptacle assembly receiving area 18 also has support sides 24. Should the base 3 of the receptacle assembly 1 get lost, the receptacles 2*a*, 2*b*, 2*c*, 2*d* can still be arranged thereon and arranged in a proper position. The trolley 15 also may have a balance support foot 25. The balance support foot 225 is a stand that balances the trolley 15. The trolley 15 is movable on two wheels, but when at rest, it cannot move, as one of the three points balancing it is a fixed, non-moving or rolling point. The trolley is not limited to only two wheels. For example a third or a second wheel may be arranged in front of the trolley where the balance support foot 225 is arranged.

Figure 10:
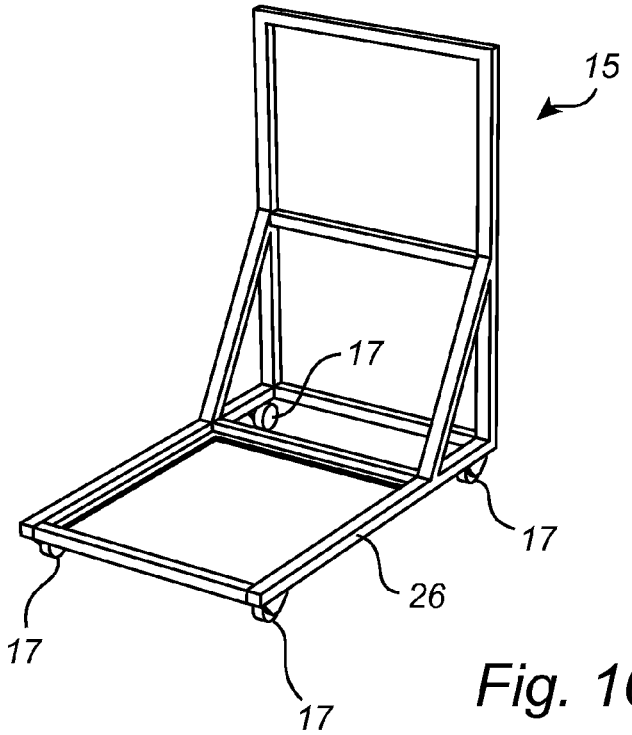
FIG. 10 shows an alternative trolley to the trolley shown in FIGS. 8 and 9.

FIG. 10 shows a trolley 15 with a frame 26 as an alternative to the platform receptacle assembly receiving area 18 in FIG. 9. The base 3 of the receptacle assembly 1 in FIG. 1 can be arranged on the frame 26. The trolley 15 also discloses four wheels 17.

Figure 11A:
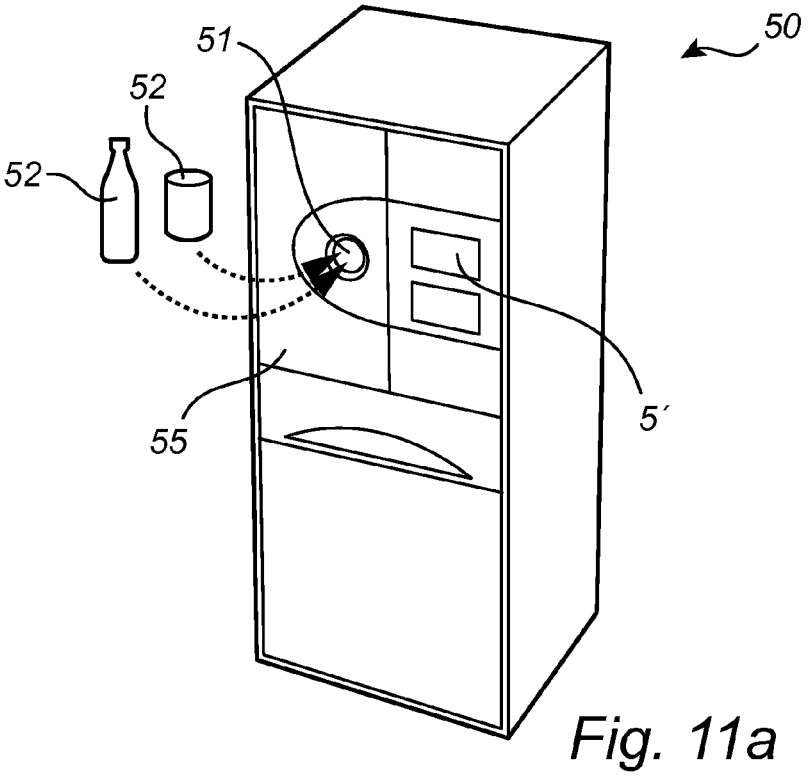
FIG. 11*a* shows a closed reverse vending machine from the front in a perspective view.
Figure 11B:
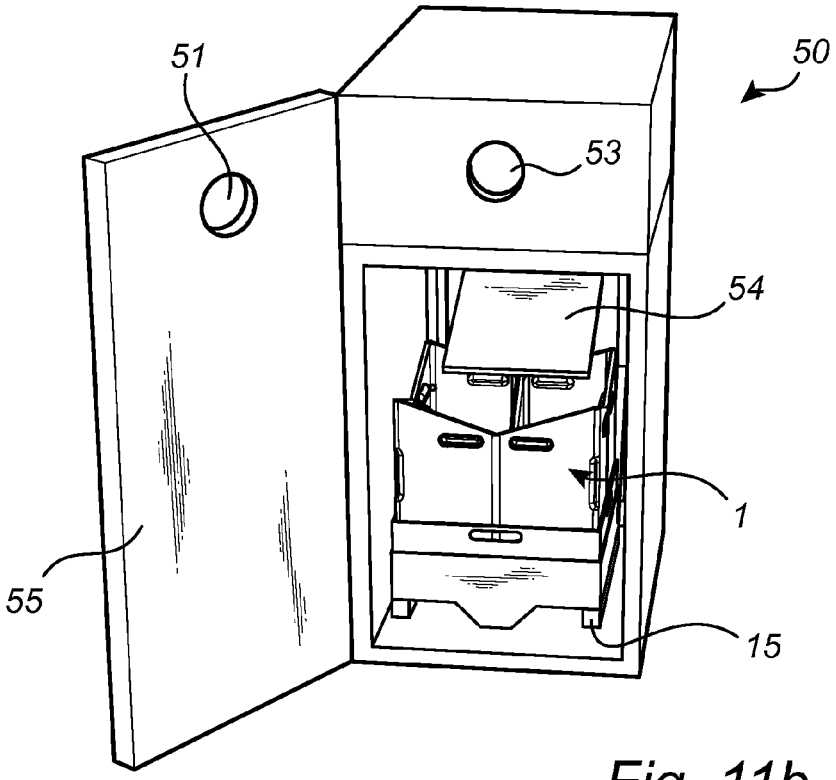
FIG. 11*b* shows the reverse vending machine in FIG. 11 when it is opened and with the trolley and the receptacle assembly shown in FIG. 8 arranged therein in perspective.

FIG. 11*a* shows a reverse vending machine 50, with an inlet 51 in the door 55, through which the empty containers 52, which shall be recycled, are inserted through. FIG. 11*b* shows the reverse vending machine 50 with the door 55 open so the inside of the reverse vending machine 50 is showing. The inlet 51 is also shown on the inside of the door 55. The empty containers will proceed through the reverse vending machine, here exemplified through a second inlet 53 which will take the empty containers to an outlet 54. The transport from the inlet 51 in the door to the outlet 54, will not be described, however it can be made in any suitable way. The trolley 15 with the receptacle assembly 1 is arranged inside the reverse vending machine 50. The trolley 15 has been inserted from the back of the reverse vending machine 100. The outlet 54 is a common outlet for the receptacle assembly 1 and it is arranged centrally over the receptacle assembly 1.

Figure 12:
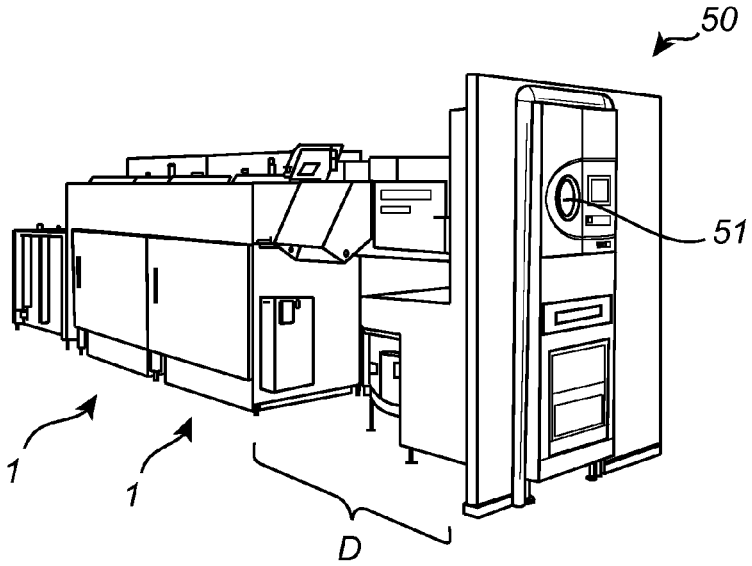
FIG. 12 shows an alternative reverse vending machine having the receptacle assembly in FIG. 1 arranged in a backroom.

FIG. 12 shows a reverse wending machine 50 having a first receptacle assembly 1 arranged at a distance D from the inlet 51 and a second one arranged even further away from the inlet. After the empty containers, which shall be recycled, are inserted through the inlet 51, the reverse wending machine 50 can sort the different empty container etc. before it is transported by means of e.g. a conveyor to the receptacle assembly 1. If, for example, both glass bottles and plastic bottles can be inserted into the same reverse vending machine through inlet 51, the machine 50 can sort them and arrange that only glass bottles is collected in one of the two receptacle assemblies 1 and the other receptacle assembly 1 will only contain the plastic bottles.

The present disclosure has mainly made above with reference to a few embodiments. However, as is readily appreciated by a person skilled in the art, other embodiments than the ones disclosed above are equally possible within the scope of the invention, as defined by the appended patent claims.

of the invention claimed is:

1. A receptacle assembly for receiving empty containers, comprising a set of receptacles and a base, said set of receptacles comprising at least a first receptacle and a second receptacle, and said base comprising guiding means adapted to control orientation of each receptacle in said set of receptacles when said set of receptacles is assembled on said base, each receptacle in said set of receptacles comprises a bottom and side walls, each sidewall having an upper edge, said receptacle assembly being adapted to be used in a reverse vending machine, and when assembled on said base each receptacle in said set of receptacles comprises at least one inner side wall and at least one outer side wall, wherein each inner side wall is arranged adjacent to a side wall of another receptacle in said set of receptacles, and each outer side wall is not facing any side wall of a receptacle in said set of receptacles, and a first inner side wall of the first receptacle in said set of receptacles is facing a first inner side wall of the second receptacle in said set of receptacles, wherein said upper edge of said first inner side wall of said first receptacle extends generally downwards from a first intersection between said first inner side wall and one first outer side wall of said first receptacle, to a point where the upper edge has a height, relative to the bottom of the first receptacle, which is lower than a height of any upper edge, relative to the bottom, of each outer side wall of said first receptacle.

2. A receptacle assembly according to claim 1, wherein said point is at a second intersection between said first inner side wall and an adjacent inner side wall.

3. A receptacle assembly according to claim 2, wherein said first receptacle further comprises a second inner side wall, and said upper edge of said second inner side wall of said first receptacle extends generally downwards from a third intersection between said second inner side wall and an outer side wall of said first receptacle, to said second intersection.

4. A receptacle assembly according to claim 3, wherein the upper edge of said first outer side wall of said first receptacle extends generally downwards from a fourth intersection between said first outer side wall and a second outer side wall of the first receptacle to said first intersection.

5. A receptacle assembly according to claim 4, wherein the upper edge of said second outer side wall of said first receptacle extends generally downwards from said fourth intersection to said third intersection.

6. A receptacle assembly according to claim 1, wherein the upper edge of said first outer side wall of the first receptacle extends downwards towards said first intersection.

7. A receptacle assembly according to claim 1, wherein said downwards extending upper edge of said first inner side wall of the first receptacle extends downwards towards a centre point of said receptacle assembly when at least said first receptacle is assembled on said base.

8. A receptacle assembly according to claim 1, wherein a height of said upper edge of said first inner side wall of said second receptacle, relative to the bottom of the second receptacle, is the same as the height of said upper edge of said first inner side wall of said first receptacle throughout the whole length of said upper edge of said first inner side wall of the first receptacle.

9. A receptacle assembly according to claim 8, wherein said guiding means of said base protrudes from said base bottom.

10. A receptacle assembly according to claim 1, wherein all receptacles in said set of receptacles are identical.

11. A receptacle assembly according to claim 1, wherein the base comprises a base bottom and base side walls enclosing said base bottom, and when said set of receptacles is assembled on said base, said base side walls are adjacent said outer side walls of each receptacle in said set of receptacles.

12. A receptacle assembly according to claim 1, wherein said guiding means of said base is integrated with said base bottom and interacts with a matching guiding means on a respective receptacle of said set of receptacles when said set of receptacles is arranged on said base.

13. A receptacle assembly according to claim 1, wherein at least said first receptacle comprises at least one handle.

14. A receptacle assembly according to claim 1, wherein at least said first receptacle comprises a handle which is integrated with said at least one inner side wall proximate to said bottom of said first receptacle.

15. A receptacle assembly according to claim 1, wherein at least said first receptacle comprises at least one handle which is integrated in said at least one outer side wall proximate to the upper edge of the at least one outer side wall.

16. A receptacle assembly according to claim 1, wherein the base comprises a base bottom and said guiding means of said base protrudes from said base bottom, at least one of said first receptacle and said second receptacle comprises a handle which is integrated in said at least one inner side wall and forms part of an underside of said bottom of said at least one of said first receptacle and said second receptacle, and said handle forms guiding means which is mutually matching with said guiding means on said base, such that when said at least one of said first receptacle and said second receptacle comprising said handle is arranged on said base said handle integrates with said guiding means on said base.

17. A receptacle assembly according to claim 1, wherein said receptacle assembly is arranged on a trolley.

18. A reverse vending machine comprising a receptacle assembly configured for receiving empty containers in the reverse vending machine, which containers have been inserted through an inlet of said reverse vending machine, said receptacle assembly is arranged under a common outlet, through which said inserted empty containers come out of after being inserted into said inlet of said reverse vending machine, said receptacle assembly comprises a set of receptacles and a base, said set of receptacles comprising at least a first receptacle and a second receptacle, and said base comprising guiding means adapted to control orientation of each receptacle in said set of receptacles when said set of receptacles is assembled on said base, each receptacle in said set of receptacles comprises a bottom and side walls, each sidewall having an upper edge, when assembled on said base each receptacle in said set of receptacles comprises at least one inner side wall and at least one outer side wall, each inner side wall being arranged adjacent to a side wall of another receptacle in said set of receptacles, and each outer side wall is not facing any side wall of a receptacle in said set of receptacles, and a first inner side wall of the first receptacle in said set of receptacles is facing a first inner side wall of the second receptacle in said set of receptacles, wherein said upper edge of said first inner side wall of said first receptacle extends generally downwards from a first intersection between said first inner side wall and one first outer side wall of the first receptacle, to a point where the upper edge has a height, relative to the bottom of the first receptacle, which is lower than a height of any upper edge, relative to the bottom, of each outer side wall of said first receptacle.

19. The reverse vending machine according to claim 18, wherein said point is at a second intersection, which is between said first inner side wall and an adjacent inner side wall.

20. The reverse vending machine according to claim 19, wherein said first receptacle further comprises a second inner side wall, and said upper edge of said second inner side wall of said first receptacle extends generally downwards from a third intersection between said second inner side wall and an outer side wall of said first receptacle, to said second intersection.

21. The reverse vending machine according to claim 20, wherein the upper edge of said first outer side wall of said first receptacle extends generally downwards from a fourth intersection between said first outer side wall and a second outer side wall of the first receptacle to said first intersection.

22. The reverse vending machine according to claim 21, wherein the upper edge of said second outer side wall of said first receptacle extends generally downwards from said fourth intersection to said third intersection.

23. The reverse vending machine according to claim 18, wherein the base comprises a base bottom and base side walls enclosing said base bottom, and when said set of receptacles is assembled on said base, said base side walls are adjacent said outer side walls of each receptacle said set of receptacles.

24. The reverse vending machine according to claim 18, wherein at least said first receptacle comprises at least one handle.

25. The reverse vending machine according to claim 18, wherein said receptacle assembly is arranged on a trolley.

* * * * *